US010987563B2

(12) United States Patent
Farres Carbonell

(10) Patent No.: US 10,987,563 B2
(45) Date of Patent: Apr. 27, 2021

(54) BATTING TRAINING DEVICE

(71) Applicant: Jordi Farres Carbonell, Sarriguren (ES)

(72) Inventor: Jordi Farres Carbonell, Sarriguren (ES)

( * ) Notice: Subject to any disclaimer, the term of this patent is extended or adjusted under 35 U.S.C. 154(b) by 0 days.

(21) Appl. No.: 16/855,261

(22) Filed: Apr. 22, 2020

(65) Prior Publication Data

US 2020/0338423 A1 Oct. 29, 2020

(30) Foreign Application Priority Data

Apr. 26, 2019 (ES) ..... ES201930668U

(51) Int. Cl.
*A63B 69/00* (2006.01)

(52) U.S. Cl.
CPC ..... *A63B 69/0075* (2013.01); *A63B 69/0002* (2013.01); *A63B 69/0091* (2013.01); *A63B 2069/0008* (2013.01); *A63B 2225/09* (2013.01)

(58) Field of Classification Search
CPC ..... A63B 69/0075; A63B 69/0091; A63B 69/0002; A63B 2225/09; A63B 2069/0008
USPC ..... 473/417, 422–429, 431, 443, 444, 451
See application file for complete search history.

(56) References Cited

U.S. PATENT DOCUMENTS 6,398,671 B1 * 6/2002 Rios ..... A63B 69/0075 273/317.6
6,551,204 B1 * 4/2003 Di Re ..... A63B 69/0002 473/417
8,246,493 B1 * 8/2012 Ling ..... A63B 21/169 473/417
8,672,780 B2 * 3/2014 Fournier ..... A63B 69/0075 473/417
2003/0224880 A1 * 12/2003 Hansberry ..... A63B 69/0002 473/430
2008/0064534 A1 * 3/2008 Lortscher ..... A63B 69/0075 473/417

* cited by examiner

*Primary Examiner* — Nini F Legesse
(74) *Attorney, Agent, or Firm* — Lucas & Mercanti, LLP

(57) ABSTRACT

A batting training device is disclosed that incorporates a ball arranged secured in an aerial position in order to be batted; has a column, wherein a tube is incorporated, arranged vertically with axial freedom of movement, an elastic cord passing through the tube, the lower end of which is fastened to the lower end of the tube, while the ball is fastened at the upper end of the elastic cord. The ball rests on the upper end of the tube. The tube is made up of segments, each segment provided on the outside with a guide slot with respect to a rod, has a bend that communicates with the slot of the adjacent segment, except for in the last lower segment, wherein the bend in the corresponding slot communicates with a return channel running along the entire length of the tube and communicates with the slot of the upper segment.

6 Claims, 10 Drawing Sheets

BATTING TRAINING DEVICE

CROSS REFERENCE TO RELATED APPLICATION

This application claims the benefit of priority of Spanish Patent Application No. U201930668, filed on Apr. 26, 2019, which is incorporated herein by reference.

TECHNICAL FIELD

The present invention is related to sports preparation for games such as baseball, wherein the action consists of hitting a ball in the air with a bat, proposing for this purpose a training device which enables batting to be practiced under certain conditions which are advantageous for preparing those practising this type of game.

BACKGROUND OF THE INVENTION

In relation to baseball or other similar games which are performed by batting, i.e., by hitting a ball thrown by another player with a bat, the practice of training by means of using supports wherein the ball is arranged to be hit with the bat is known, with the aim of developing skill in batting.

In this manner, there are different types of supports, some only act as sustaining means for the ball, which must be replaced by the player in the placement position on the support after each batting; others hold the ball in place without it coming off the support when batted; others have an automatic return system for the ball after batting; and some even have embodiments which enable the height at which the ball is sustained to be modified in order to adapt it to the type of batting to be trained, in this case the player being the person who modifies the positioning of the ball each time they so desire.

These supports, however, lack effectiveness for effective batting training according to the conditions required in the game, since, given the circumstances of performing the activity in the real game, the player who has to bat cannot predict the position of the ball in the air at the time of the batting, since said position depends on the throw made by the throwing player.

Thus, in order to perform effective batting training, it is necessary to develop a support which places the position of the ball to be batted in different positions which are related to the variety of situations that may occur when batting during the real game, which is the object of the training.

SUMMARY OF THE INVENTION

According to the invention, a batting training device is proposed, developed with structural and functional features which enable the batting position to be restored after each hit of the ball which is batted, with an automatic change in the position of the ball in the air each time due to the very energy from the batting.

This device object of the invention has a column which is secured at the lower portion with a flexible anchoring, said column comprising a tube, through the inside of which an elastic cord extends, the lower end of which is fastened in a fixed manner to the lower end of the tube, while at the upper end of the elastic cord a ball is fastened which rests on the upper portion of the tube, and the tube is made up of a succession of segments. Each of the segments is provided on the outside with a longitudinal guide slot having a bend which communicates with the slot of the segment which continues immediately beneath it, except for the slot of the last lower segment, which communicates with a return channel which continuously runs along all the segments until the upper portion of the tube, wherein said return channel communicates with the slot of the upper segment of the tube, the tube passing through a ring which is secured by vertical bars and has a radially-incorporated rod which enters the slot of the segments of the tube.

A device is thus obtained wherein the ball to be batted is secured by the elastic cord which returns it to the positioning on the tube of the device after each hit of the bat, such that, when batting, the ball is separated from the tube by the force of the hit, enabling the tube to move axially one space wherein the rod of the ring runs along the slot of a segment of the tube to be locked in the lower bend in the slot of the segment, the tube thereby passing, in each batting, to stay locked in a subsequent lower segment, which implies a change in position of the height of the ball in the air for the next batting, until it reaches the lower segment of the tube, from which it returns to the initial position with the tube in the lowest position.

In this manner, the player who practises the training only has to make the batting hits, the positioning of the ball automatically changing each time, without the player having to worry about picking up and placing the ball for each new batting.

Moreover, the changes in the position of the ball and the placement thereof for each new batting are performed by the very energy of the batting hits, without needing any electrical supply, which enables the device to be used anywhere to train.

Therefore, the envisaged device results from features which are very advantageous for the function of batting training for which it is intended, acquiring its own identity and preferred character compared to conventional devices used for the same function.

DETAILED DESCRIPTION OF THE INVENTION

Figure 1:
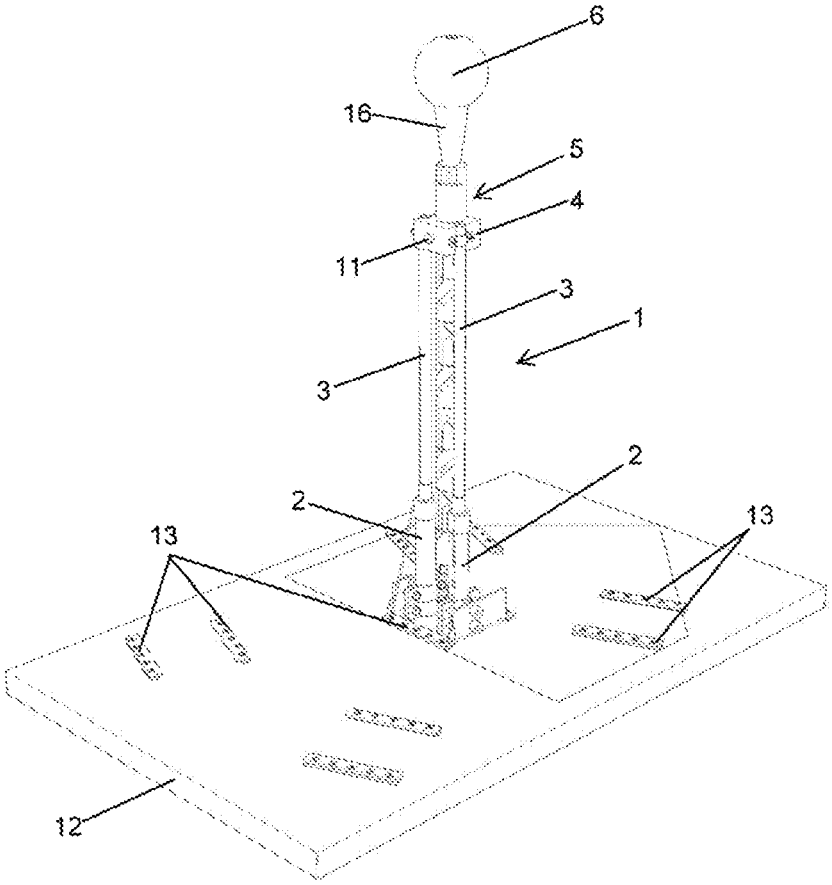
FIG. 1 shows a perspective view of a practical exemplary embodiment of the batting training device object of the invention, with the tube of the device in the lowest position.
Figure 2:
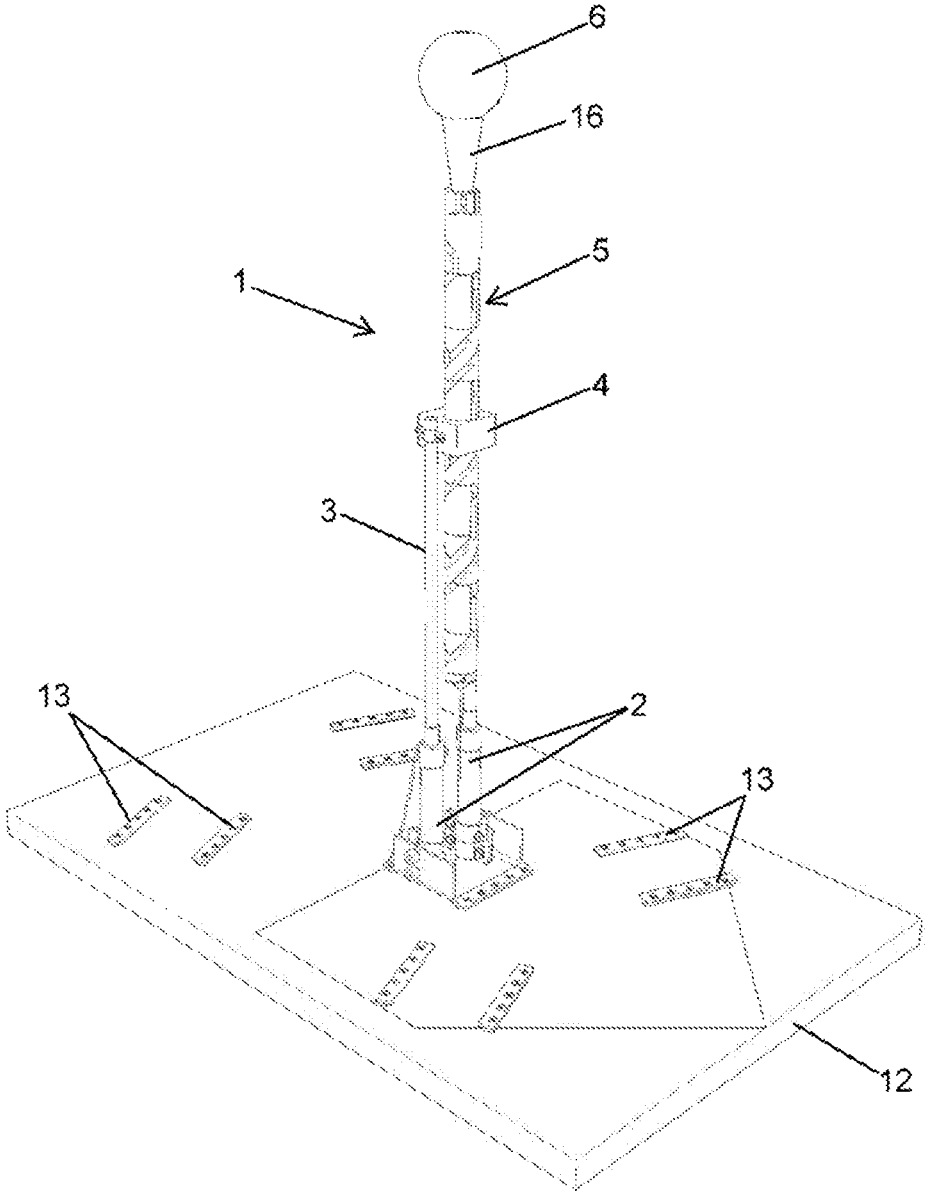
FIG. 2 is a perspective view of the same device of the previous figure, with the tube of the device in an intermediate position.

The object of the invention refers to a device for training the batting practiced in baseball and other similar games, comprising a column (1) which is secured at the lower portion with a flexible anchoring (2), said column (1) being formed by vertical bars (3) wherein a ring (4) is secured on top, through which a tube (5) passes with axial freedom of movement whereon a ball (6) is arranged.

In this assembly, the ball (6) is fastened to an elastic cord (7) which extends longitudinally through the inside of the tube (5), the lower end of said elastic cord (7) being fastened to the lower end of the tube (5), while at the upper end a ball (6) is fastened, which rests on the upper end of the tube (5), whereon it is secured by the tension of the elastic cord (7).

Figure 5:
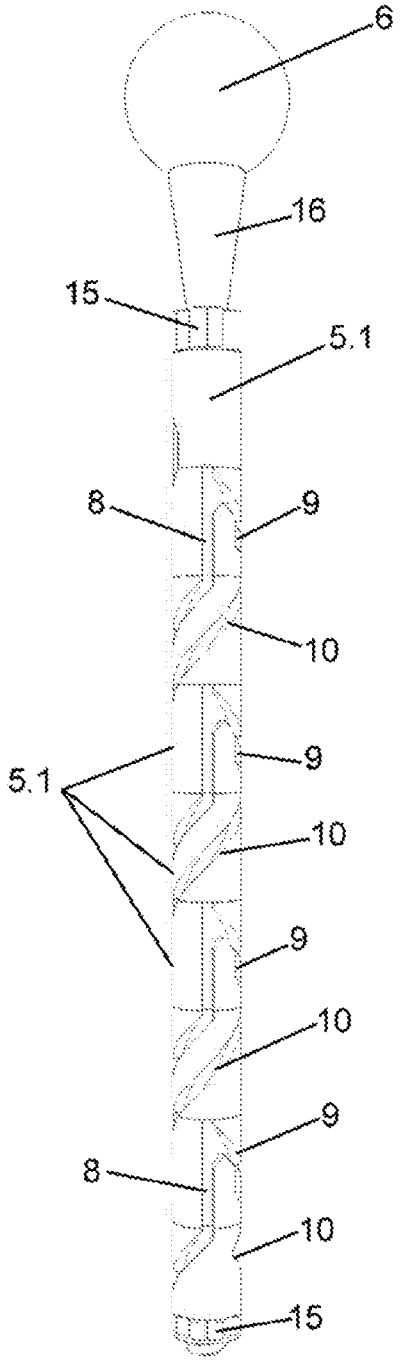
FIG. 5 is a perspective view of the tube of the device with the ball in an assembled position of all the component assembly.
Figure 6:
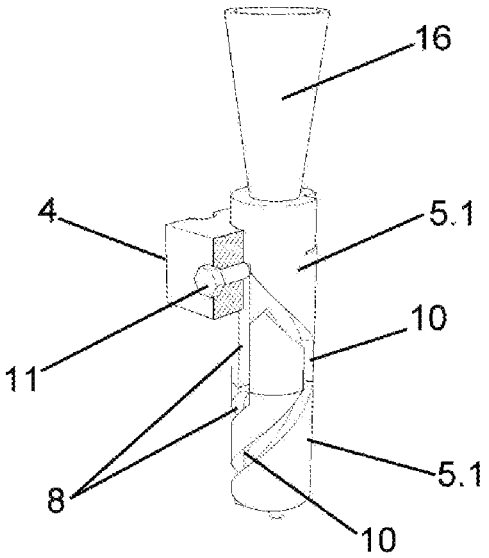
FIG. 6 is a perspective view of a partial upper portion of the tube of the device with the ring surrounding the tube in a diametrical cross section.
Figure 7A:
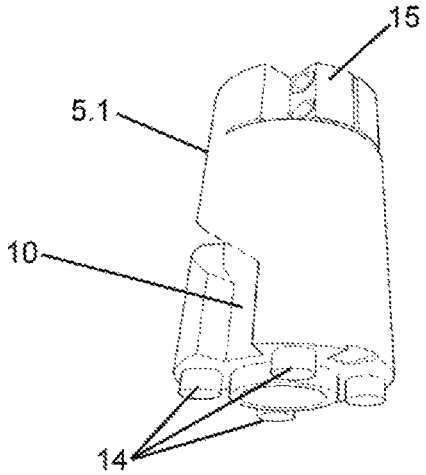
FIGS. 7A to 7D are four perspective views from different observation angles of the upper segment of the composition of the tube of the device of the invention.
Figure 7B:
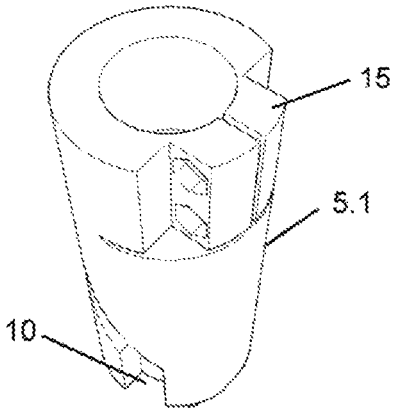
Figure 7C:
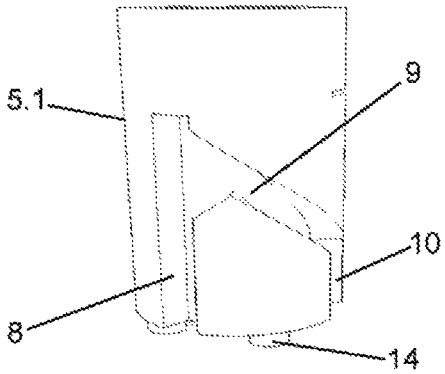
Figure 7D:
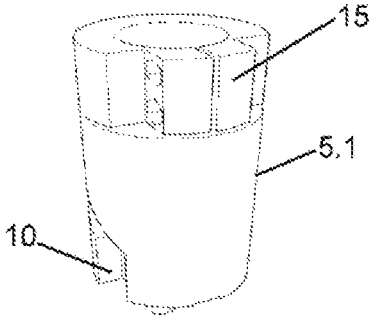
Figure 8A:
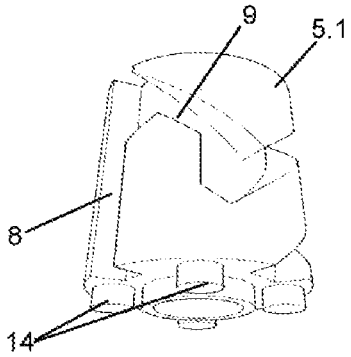
FIGS. 8A to 8D are four perspective views from different observation angles of an intermediate segment of the composition of the tube of the device of the invention.
Figure 8B:
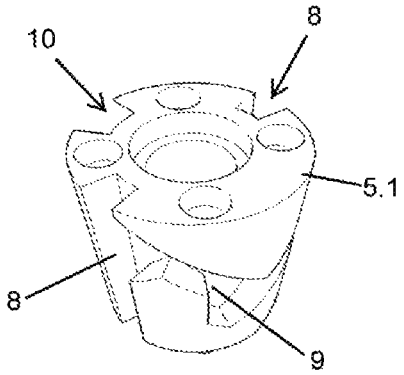
Figure 8C:
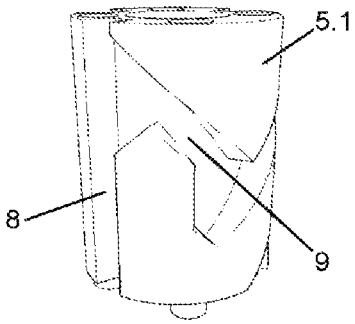
Figure 8D:
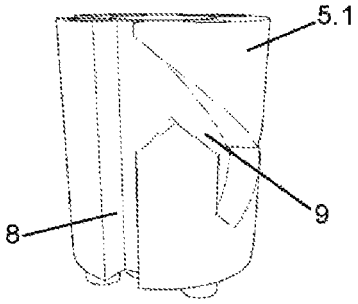
Figure 9A:
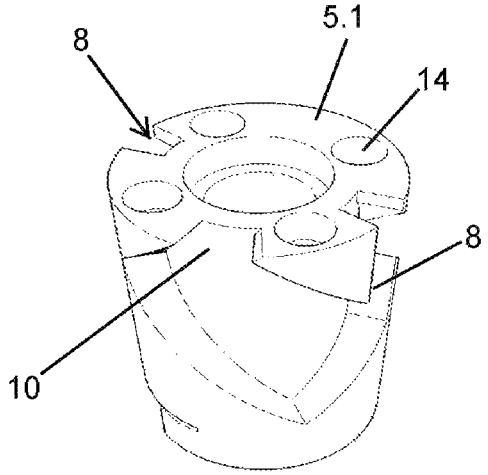
FIGS. 9A to 9D are four perspective views from different observation angles of the lower segment of the composition of the tube of the device of the invention.
Figure 9B:
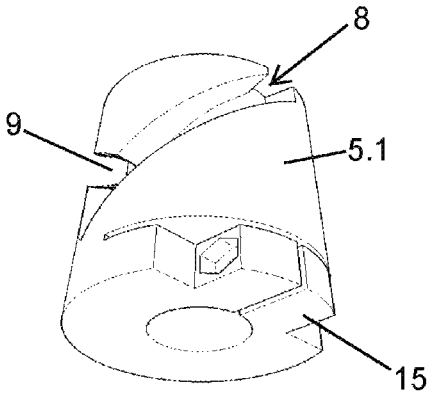
Figure 9C:
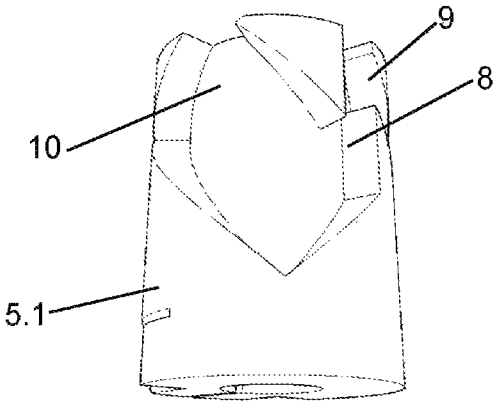
Figure 9D:
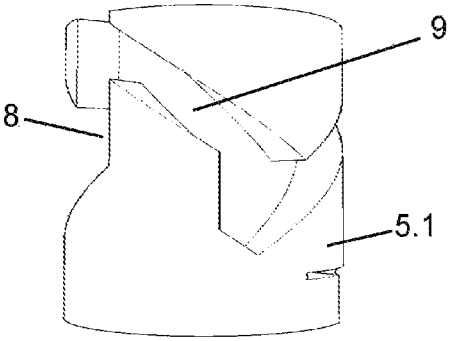

The tube (5) is longitudinally made up of a series of segments (5.1), each one provided longitudinally on the outside with a slot (8), which has a bend (9), as seen in FIGS. 8A to 8D, such that, as seen in FIG. 5, in the assembly of the tube (5), the bend (9) in the slot (8) of each segment (5.1) communicates with the slot (8) of the next segment (5.1) beneath it, except in the last lower segment (5.1), wherein, as seen in FIGS. 9A to 9D, the bend (9) in the respective slot (8) communicates with a return channel (10) which extends longitudinally in a continuous manner along the entire tube (5), until reaching the upper segment (5.1), wherein said return channel (10) communicates with the slot (8) of the aforementioned upper segment (5.1), as seen in FIGS. 7A to 7D.

Moreover, the ring (4) incorporates a rod (11) which radially protrudes towards the inside, such that said rod (11) penetrates the outer slot (8) of the segments (5.1) of the tube (5), being able to run, like a guide, through the assembly of the slots (8) of all the segments (5.1) and through the return channel (10) which links them from end to end of the tube (5).

Figure 4:
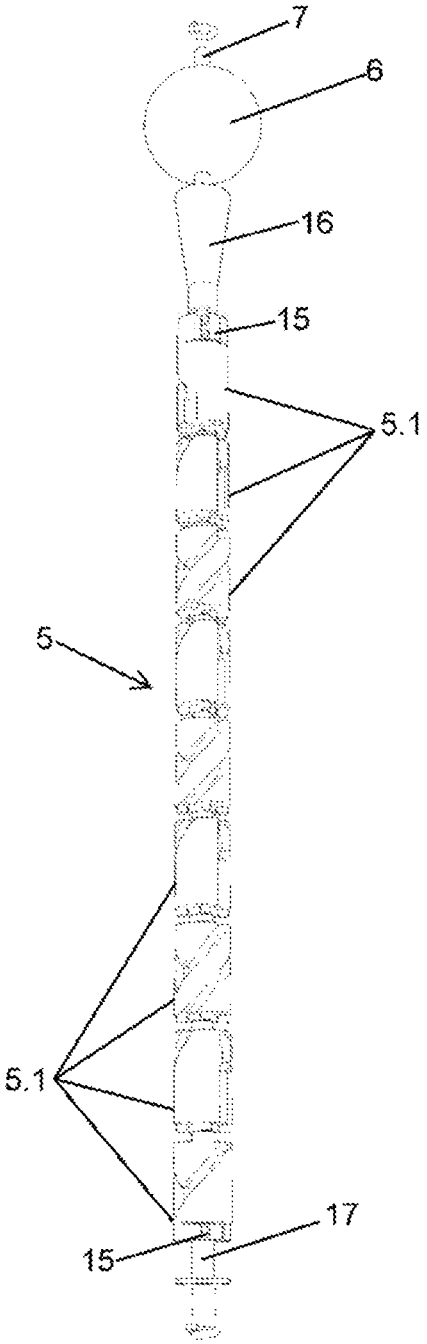
FIG. 4 is an exploded perspective view of the tube of the device with the ball secured therein.

It is foreseen that inside the tube (5) there is an inner tube (17) which houses the elastic cord (7) therein. See FIG. 4. Said inner tube (17) is fastened to the tube (5). To do so, the tube (5) has, in the upper and lower segments (5.1), tightening structures (15) which fasten the inner tube (17).

The ball (6) is arranged on a support (16) made of elastic material which rests on the upper end of the tube (5). Said support (16) has a dual function, on the one hand, it enables the ball (6) to be separated from the upper end of the tube (5) in order to facilitate the hitting thereof and to prevent the tube (5) from being hit accidentally, and, on the other hand, it dampens the return of the ball (6) such that the tube (5) is not affected.

Specifically, as seen in FIGS. 8A to 8D, the intermediate segments (5.1) have a first path to guide the tube (5) upwards and a second path to guide the tube (5) downwards. The first path is made up of a straight segment arranged in continuity with a V-shaped segment, which corresponds to the slot (8) and the bend (9), while the second path is made up of a curved segment which corresponds to the return channel (10).

As seen in FIGS. 7A to 7D, in the upper segment (5.1), the first path formed by the slot (8) and the bend (9) meet the return channel (10), and exactly the same thing happens in the lower segment (5.1) shown in FIGS. 9A to 9D.

Figure 10:
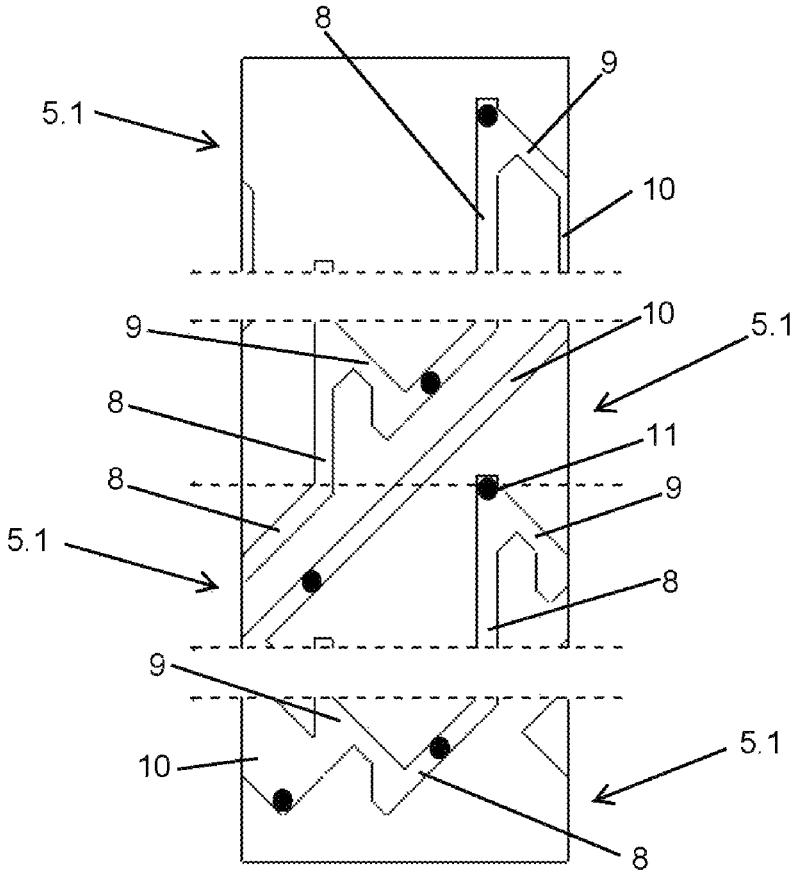
FIG. 10 shows a diagram of the path for the rod of the ring surrounding the tube of the device through the slot and the return channel of the component segments of the tube.

Thus, when the ball (6) is batted, the force of the hit causes the elastic cord (7) to extend, enabling the tube (5) to move axially one space following the ball (6), with which, as seen in FIG. 10, the rod (11) of the ring (4) runs through the slot (8) of a segment (5.1) of the tube (5), until the corresponding lower bend (9), wherein said rod (11) stays locked, thus producing, in each batting, a movement of the tube (5) in a length equivalent to one segment (5.1), such that the ball (6) is located for the next batting in a different, higher position; said change in position of the height of the ball (6) being made each time batting is performed, until the rod (11) of the ring (4) reaches the lower segment (5.1) of the tube (5), in which situation the ball (6) stays in the highest position, since in the next batting, the rod (11) is introduced into the return channel (10), through which it runs until the upper segment (5.1) of the tube (5), the tube (5) thus moving downwards as far as the entire length thereof, with which the ball (6) stays in the lowest position, in order to once again start, with the successive batting, the sequence of movements upwards as far as the length of each of the segments (5.1).

Therefore, with this device object of the invention, each time batting is performed, the ball (6) is automatically placed in a position with a different height for the next batting, enabling batting to be trained in different positions, without the user having to worry about anything except for batting.

Figure 3:
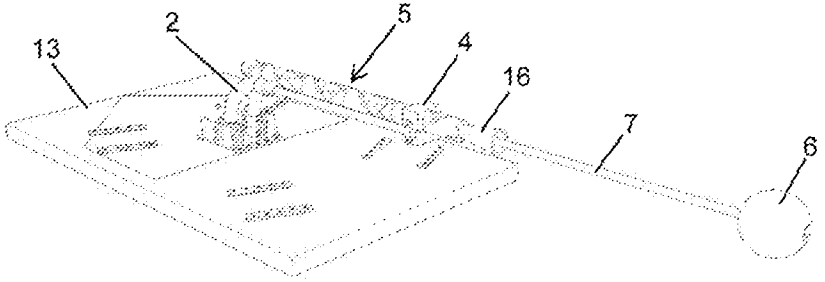
FIG. 3 is a perspective view of the device with the column collapsed in a horizontal position.

The anchoring (2) is foreseen to be formed by springs or other elements with similar features providing flexibility, in order to favour the function of the device and prevent a rigidity that can cause damage due to the impact of batting on the ball (6); however, a rigidity of said anchoring (2) is provided so that the column (1) immediately recovers the vertical position thereof after each batting, without continuing to oscillate for a prolonged time in said recovery. However, the flexibility of the anchoring (2) enables the column (1) to be collapsed to a horizontal position, as shown in FIG. 3.

The assembly of the column (1) of the device is foreseen, furthermore, to be secured, by means of a fastening (13), on a sustaining base (12), with which the device can be used practically anywhere without needing securing fasteners in the ground, the sustaining base (12) being foreseen to have several fasteners (13) in order to secure different devices, with the aim of the user being able to train batting actions in different contact positions with the ball (6) without changing the position of the user.

According to a practical embodiment, which favours manufacturing, the component segments (5.1) of the tube (5) are made up of independent parts, provided with structures (14) for joining and positioning between said parts in the formation of the tube (5). However, the component segments (5.1) of the tube (5) can be made in a single part wherein the slot (8) and the return channel (10) are defined, connecting the slot (8) and the channel (10) both at the upper portion and at the lower portion of the tube (5).

The invention claimed is:

1. A batting training device, incorporating a ball which is arranged secured in an aerial position to be batted, comprising a column comprising a tube incorporated in the column and arranged vertically with axial freedom of movement, an elastic cord passing through said tube, a lower end of said elastic cord is fastened to a lower end of the tube, while at an upper end of said elastic cord the ball is fastened, the ball resting on an upper end of the tube, and the tube comprising a plurality of segments, each segment comprising a longitudinal guide slot with respect to a rod, the longitudinal guide slot having a bend which communicates with the longitudinal guide slot of an adjacent segment, wherein in a last lower segment, the bend in the corresponding longitudinal guide slot communicates with a return channel which runs along an entire length of the plurality of segments of the tube and which communicates with the longitudinal guide slot of an upper segment.

2. The batting training device, according to claim 1, wherein the tube passes through a ring wherein the ring incorporates the rod arranged protruding towards an inner cavity of the ring in order to run through the longitudinal guide slot of the segments and through the return channel in axial movements of the tube when the ball is batted.

3. The batting training device, according to claim 1, wherein the column is secured at a the lower portion by means of a flexible anchoring.

4. The batting training device, according claim 1, wherein the segments of the tube are independent parts provided with structures by means of which said parts are joined and positioned in relation to each other in forming the tube.

5. The batting training device, according to claim 1, wherein the column is securely arranged on a sustaining base, wherein several fasteners are used in said sustaining base in order to secure different batting training devices positioned in different orientations.

6. The batting training device, according to claim 1, wherein the ball is arranged in a support made of elastic material which rests on the upper end of the tube.

* * * * *